US008132613B2

(12) United States Patent
Hirata et al.

(10) Patent No.: US 8,132,613 B2
(45) Date of Patent: Mar. 13, 2012

(54) CORE-SETTING APPARATUS USED FOR A MOLDING APPARATUS AND A METHOD FOR SETTING A CORE

(75) Inventors: Minoru Hirata, Toyokawa (JP); Koichi Sakaguchi, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 574 days.

(21) Appl. No.: 12/260,618

(22) Filed: Oct. 29, 2008

(65) Prior Publication Data

US 2009/0121382 A1 May 14, 2009

Related U.S. Application Data

(63) Continuation-in-part of application No. 12/020,164, filed on Jan. 25, 2008, now abandoned.

(30) Foreign Application Priority Data

Oct. 11, 2007 (JP) ..... 2007-265425

(51) Int. Cl.
*B22D 33/04* (2006.01)

(52) U.S. Cl. ..... 164/397; 164/30; 164/137; 164/340

(58) Field of Classification Search ..... 164/30, 164/137, 340, 397
See application file for complete search history.

(56) References Cited

U.S. PATENT DOCUMENTS 3,910,343 A * 10/1975 Popov et al. ..... 164/340
4,590,982 A * 5/1986 Hunter ..... 164/253
4,848,440 A * 7/1989 Hunter ..... 164/253
6,868,894 B2 * 3/2005 Knudsen ..... 164/340

FOREIGN PATENT DOCUMENTS

WO WO 02/43901 A1 6/2002

* cited by examiner

*Primary Examiner* — Jessica L Ward
*Assistant Examiner* — Kevin E Yoon
(74) *Attorney, Agent, or Firm* — Finnegan, Henderson, Farabow, Garrett & Dunner, L.L.P.

(57) ABSTRACT

A core-setting apparatus and a method for setting the core in a lower mold used in a molding apparatus, wherein the core-setting apparatus has a simple structure and can maintain the core in the mold in a highly accurate position. The core-setting apparatus to set a core in the lower mold while the upper and the lower mold and a match plate are separated from each other after molding the upper and lower mold in a cope and drag flask includes a handling tool having a holding device and a rotatable rod, wherein the handling tool is rotatably supported by the rod, a carrier for transferring the handling tool, wherein the carrier supports the rotatable rod and is moved to or from a location above the lower mold, and an actuator for lowering and lifting the cope flask together with the carrier and the handling tool which are located above the drag flask, the actuator being mounted on the main body of the molding apparatus.

3 Claims, 20 Drawing Sheets

CORE-SETTING APPARATUS USED FOR A MOLDING APPARATUS AND A METHOD FOR SETTING A CORE

CROSS REFERENCE TO RELATED APPLICATIONS

This application is a continuation-in-part application of U.S. application Ser. No. 12/020,164, filed Jan. 25, 2008 now abandoned, and claims the right to priority based on Japanese Application No. 2007-265425, filed Oct. 11, 2007, the content of both of which is incorporated herein by reference.

TECHNICAL FIELD

These inventions relate to a core-setting apparatus used for a flaskless molding apparatus for producing a pair of an upper and a lower mold, which molding apparatus uses a match plate, and a method for setting a core.

BACKGROUND OF THE INVENTIONS

Conventionally, as one core-setting apparatus that is used for a flaskless molding apparatus for producing a pair of an upper and a lower mold by using a match plate, there is a type of apparatus that comprises the following:

after a drag flask is placed outside the apparatus by moving it forward from the apparatus, wherein the drag flask is movable forward and backward, a core-setting apparatus sets a core in a lower mold in the drag flask, wherein the core-setting apparatus is disposed above the drag flask. (See Patent Document 1.)

Patent Document 1: Pamphlet of International Patent Laid-open Publication No. WO 02/43901 (See FIG. 3.)

DISCLOSURES OF INVENTIONS

However, for the inventions of Patent Document 1, since a drag flask must be able to move backward and forward, it becomes a problem in that the structure of the apparatus becomes complicated. Further, since a core is set in a mold by lifting the drag flask under the condition that the drag flask is placed outside the apparatus by moving it forward from the apparatus, that is, while the drag flask is supported in a cantilevered state, it becomes another problem in that it is hard to keep the position of the core accurate.

The present inventions have been conceived to solve these problems. Namely, the purpose of them is to provide a core-setting apparatus used for a molding apparatus and a method for setting a core in a mold that can simplify the structure of the molding apparatus and that can maintain the core in a highly accurate position.

To solve these problems, a core-setting apparatus is used for a molding apparatus for producing an upper and a lower mold of these inventions. The molding apparatus has processes comprising:

a molding-space-defining step to define molding spaces, each space having a predetermined volume, in a cope and a drag flask by inserting an upper and a lower squeeze means into the cope and the drag flask respectively while a match plate is held between the cope and the drag flask, a sand-filling step to fill the molding spaces with molding sand, and a squeezing step to squeeze the molding sand in the molding spaces by the upper and the lower squeeze means, characterized in that the core-setting apparatus to set a core in the lower mold while the upper and the lower mold and the match plate are separated each other after molding the upper and the lower mold comprises:

a handling tool to handle the core, comprising a holding means to hold the core and a rotatable rod supporting the handling tool about its axis, a carrier for transferring the handling tool, wherein the carrier supports the rotatable rod and is moved to or from the location above the lower mold, and an actuator for lowering and lifting the cope flask together with the carrier and the handling tool which are located above the drag flask, wherein the actuator is mounted on the main body of the molding apparatus.

The core-setting apparatus of these inventions that are used for the molding apparatus further comprises a pair of perpendicularly movable rails disposed at both outer side walls of the cope flask, wherein the rails can be moved perpendicularly together with the cope flask, and wherein the carrier and the handling tool can also be lowered and lifted together with the cope flask when the carrier and the handling tool are moved to a position above the drag flask by using the pair of perpendicularly movable rails.

To solve the above problems, the method for setting a core is used for the molding apparatus for producing an upper and a lower mold of these inventions. The molding apparatus has processes comprising:

a molding-space-defining step to define molding spaces, each space having a predetermined volume, in a cope and a drag flask by inserting an upper and a lower squeeze means into the cope and the drag flask respectively while a match plate is held between the cope and the drag flask, a sand-filling step to fill the molding spaces with molding sand, and a squeezing step to squeeze the molding sand in the molding spaces by the upper and the lower squeeze means, characterized in that the method for setting the core in the lower mold while the upper and the lower mold and the match plate are separated from each other after molding the upper and the lower mold comprises:

a holding step to hold the core by operating a holding means after inserting the core in a handling tool, a positioning step to position the core held by the handling tool so that the core faces the lower mold by moving a carrier supporting a rotatable rod of the handling tool to the position above the lower mold and by rotating the handling tool forwardly about the rotatable rod, a lowering step to lower the core to just in front of the surface of the lower mold or to a position where the core contacts the surface, which core is held by the handling tool, by forwardly moving an actuator for lowering or lifting the cope flask, wherein the actuator, which is mounted on the main body of the molding apparatus, can lower and lift the carrier, which is transferred to the position above the lower mold, and can also lower and lift the handling tool together with the cope flask, a setting step to set the core in the lower mold by releasing the core from the holding means at the lowered position, a lifting step to lift the carrier and the handling tool by inversely moving the actuator for lowering and lifting the cope flask, and a removing and rotating step to take the carrier from the position above the lower mold and to inversely rotate the handling tool.

The method for setting the core used for the molding apparatus for producing the upper and the lower mold of these inventions further comprises:

a pressurizing step to pressurize the core by compressed air while setting the core after lowering it to a position just in front of the surface of the lower mold or to a position where the core contacts the surface, which core is held by the handling tool, and releasing the core from the holding means.

These inventions include the following technical features:

a core-setting apparatus used for a molding apparatus having processes comprising:

a molding-space-defining step to define molding spaces, each space having a predetermined volume, in a cope and a drag flask by inserting an upper and a lower squeeze means into the cope and the drag flask respectively while a match plate is held between the cope and the drag flask, a sand-filling step to fill the molding spaces with molding sand, and a squeezing step to squeeze the molding sand in the molding spaces by the upper and the lower squeeze means, characterized in that the core-setting apparatus to set a core in the lower mold while the upper and the lower mold and the match plate are separated from each other after molding the upper and the lower mold comprises:

a handling tool to handle the core, comprising a holding means to hold the core and a rotatable rod supporting the handling tool about its axis, a carrier for transferring the handling tool, wherein the carrier supports the rotatable rod and is moved to or from a location above the lower mold, and an actuator for lowering and lifting the cope flask together with the carrier and the handling tool which are located above the drag flask, wherein the actuator is mounted on the main body of the molding apparatus. Since these inventions have these technical features, they have different types of effects, such as that the structure of the apparatus can be simplified, and that it is possible to maintain the accuracy of the position of the core when the core is set in the lower mold.

BRIEF DESCRIPTIONS OF THE DRAWINGS

Figure 2:
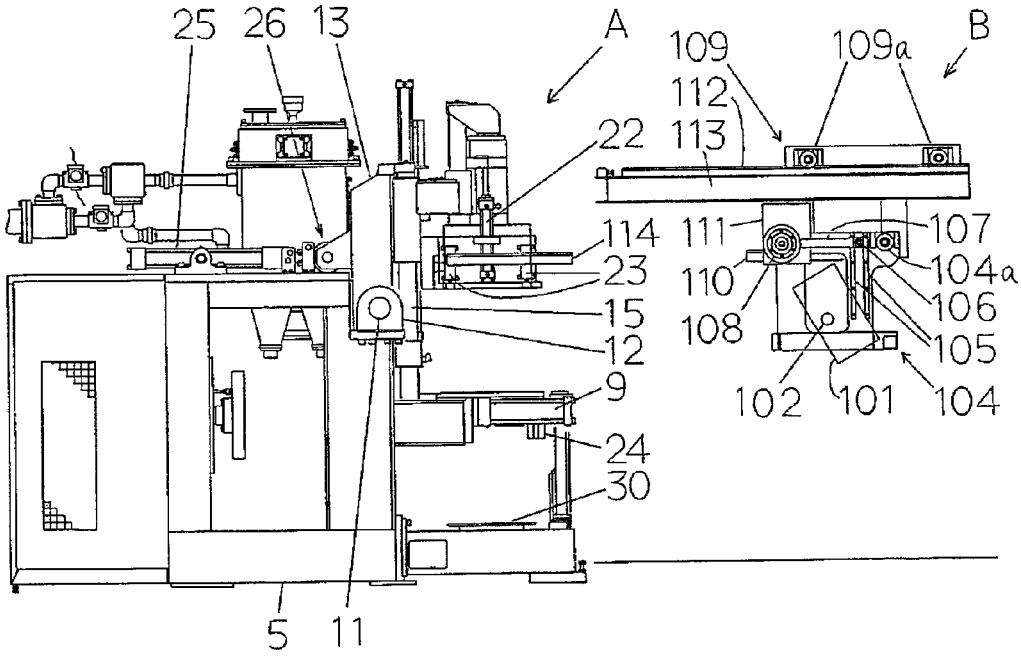
FIG. 2 is an elevational view of the core-setting apparatus of these inventions showing one of the embodiments used for the molding apparatus.
Figure 3:
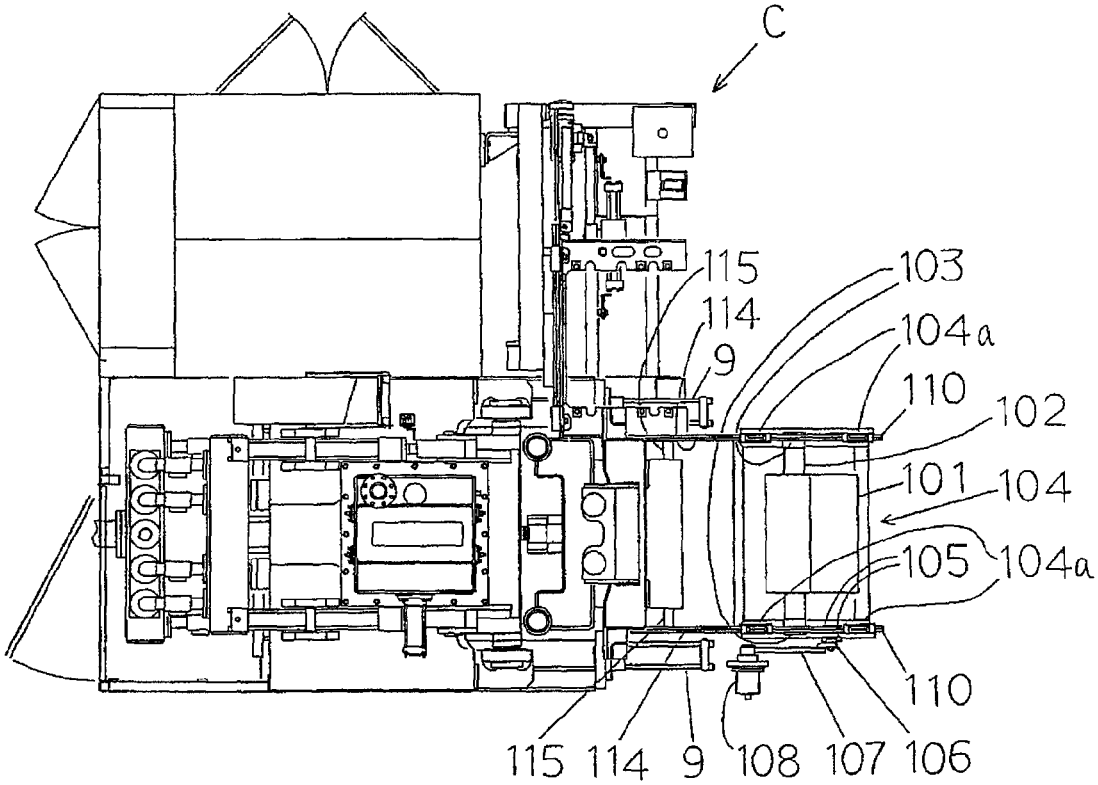

FIG. 3 is a plane view of FIG. 2. Part of FIG. 2 is omitted. FIG. 3 shows that the carrier and a transferring carriage are moved forward.

Figure 4:
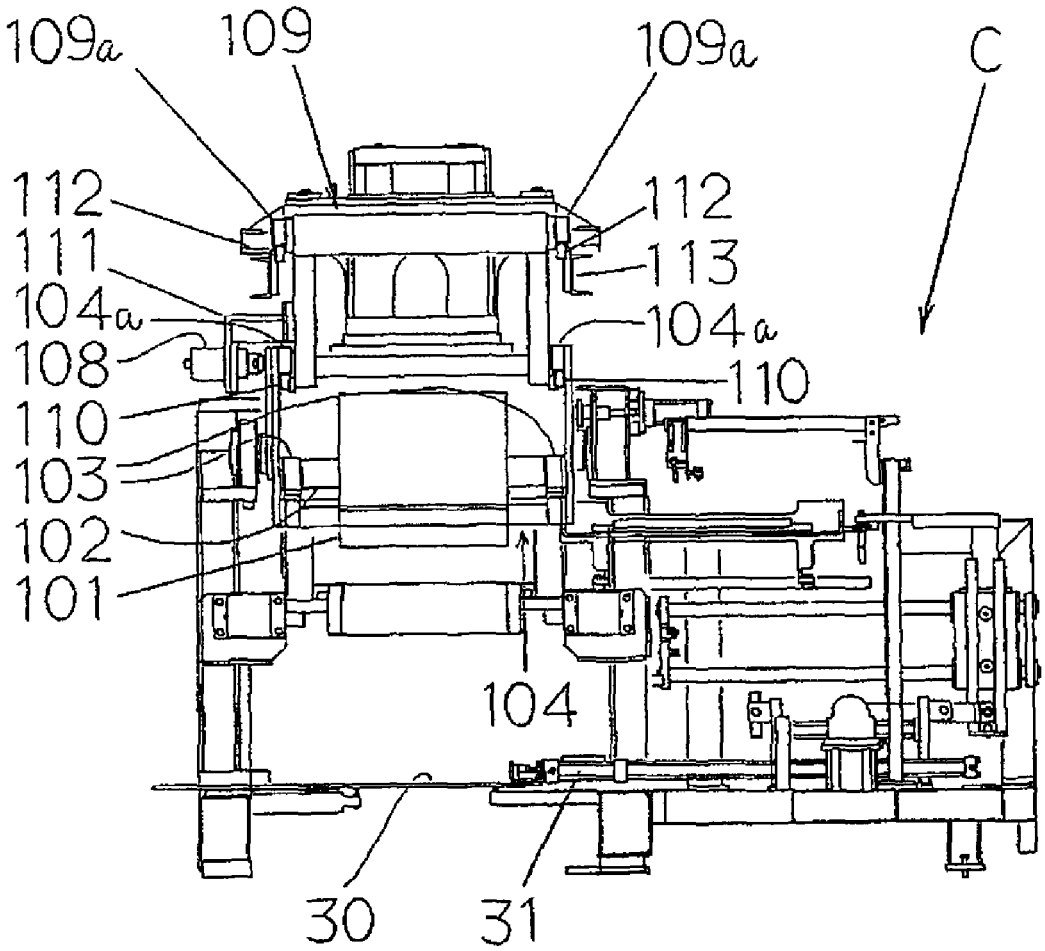

FIG. 4 is a view of the right side of FIG. 2. Part of FIG. 2 is omitted.

Figure 5:
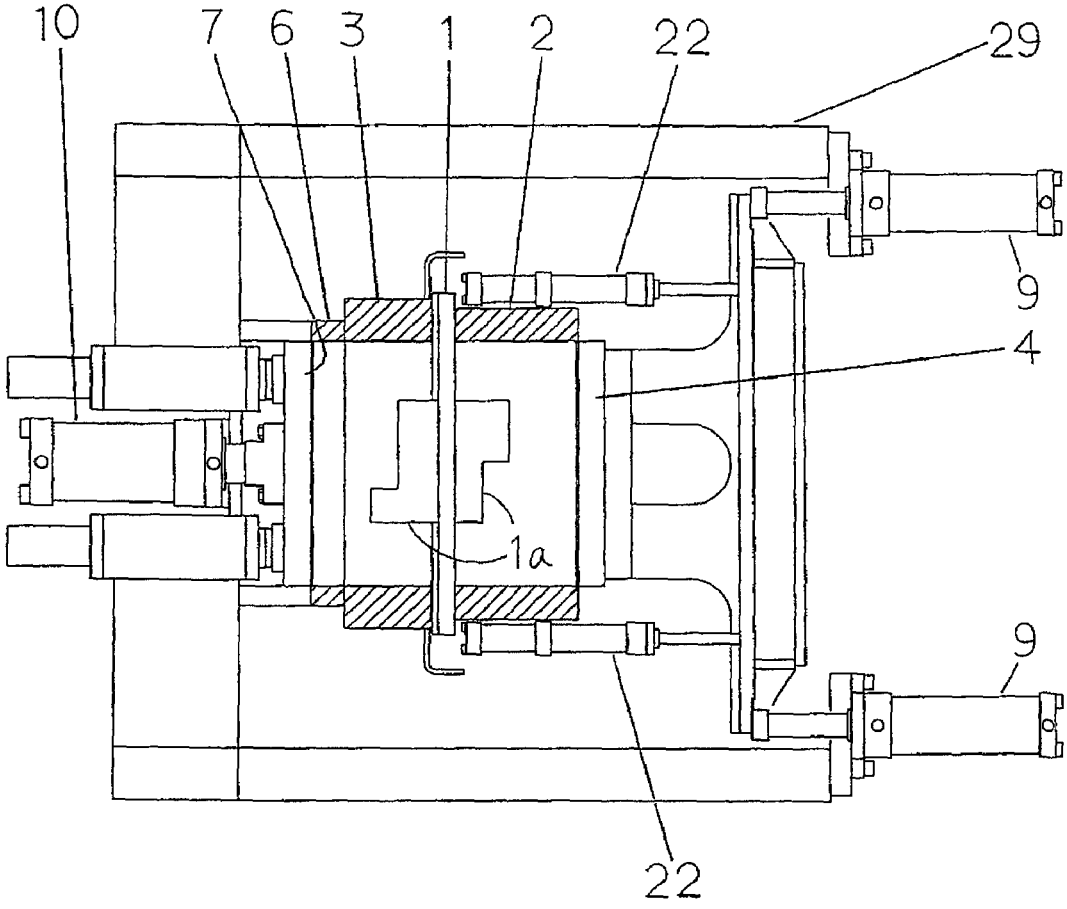

FIG. 5 is a plane view of a pair of molding spaces defined in the flasks by the molding apparatus. Some relevant elements are omitted.

Figure 6:
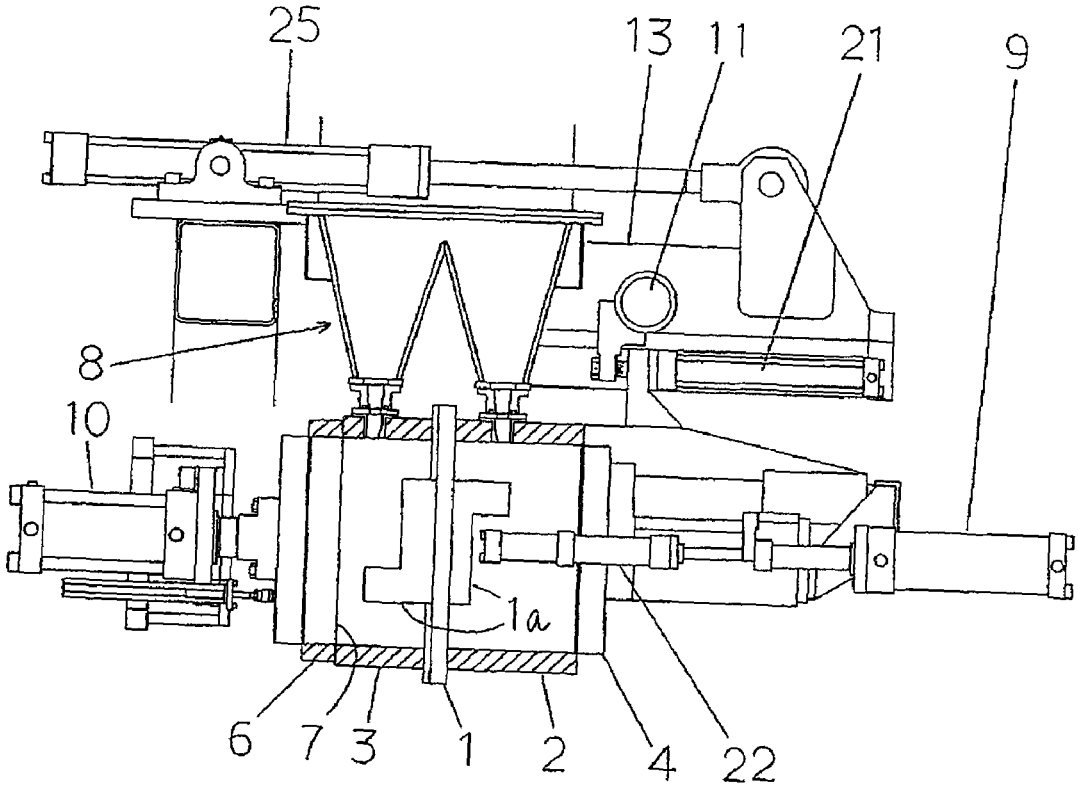

FIG. 6 is an elevational and a partially sectional view of a pair of molding spaces defined in the flasks by the molding apparatus. Some relevant elements are omitted.

Figure 7:
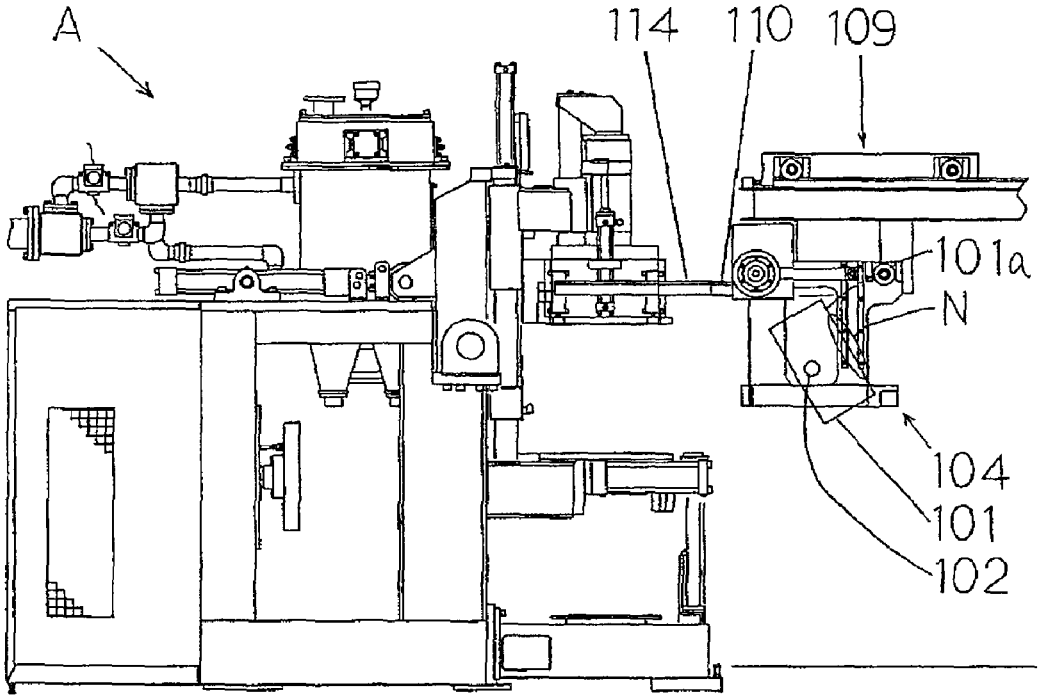

FIG. 7 is an elevational view of the core-setting apparatus, and shows that the core is held in the handling tool, which is at an initial position.

Figure 8:
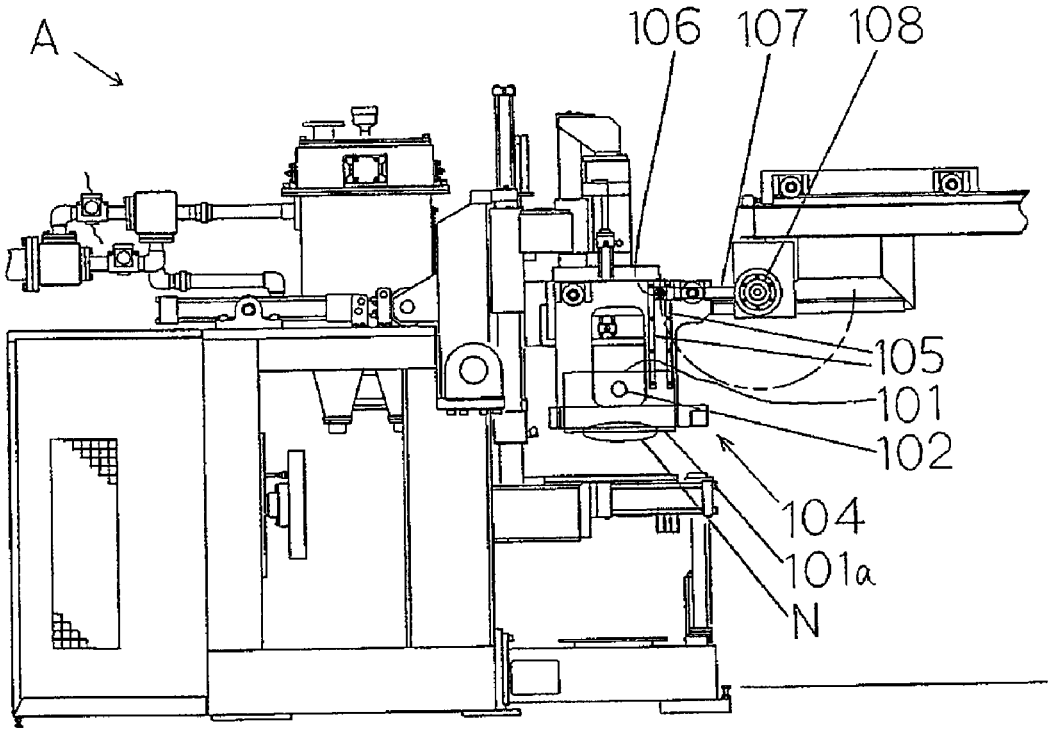

FIG. 8 is an elevational view of the core-setting apparatus. It shows that the carrier is moved to a position above the lower mold, and that the core faces the lower mold.

Figure 9:
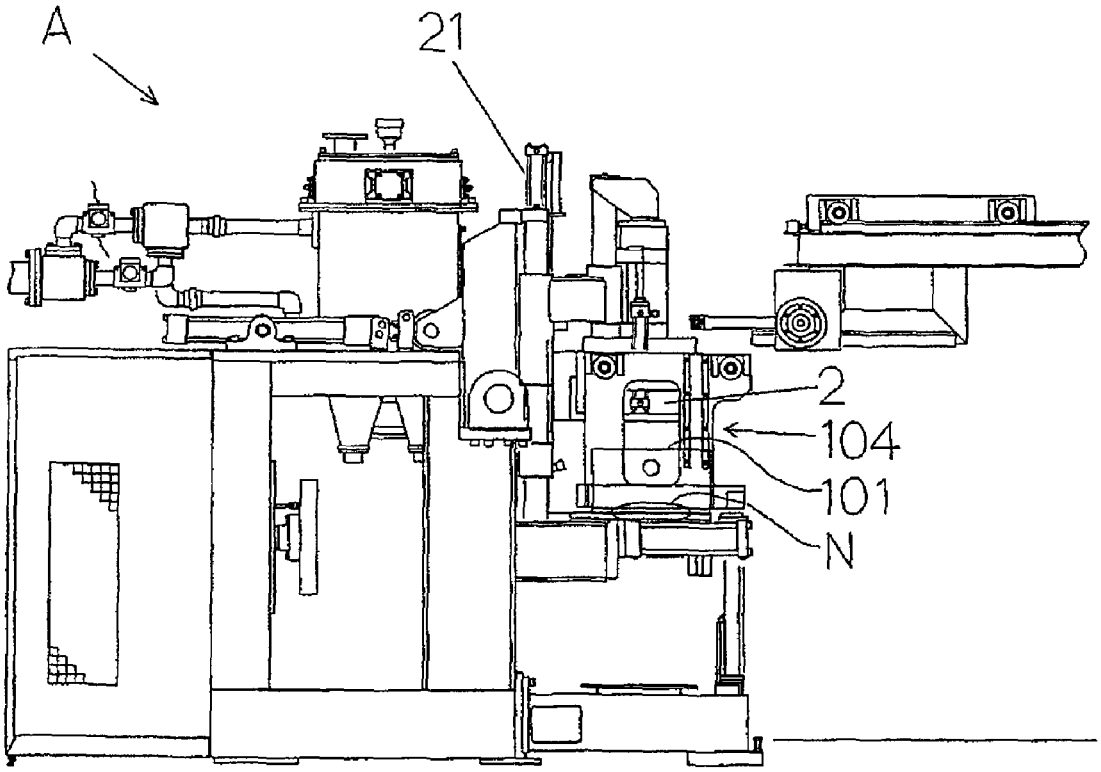

FIG. 9 is an elevational view of the core-setting apparatus, and shows that the core is lowered to just in front of the surface of the lower mold.

Figure 10:
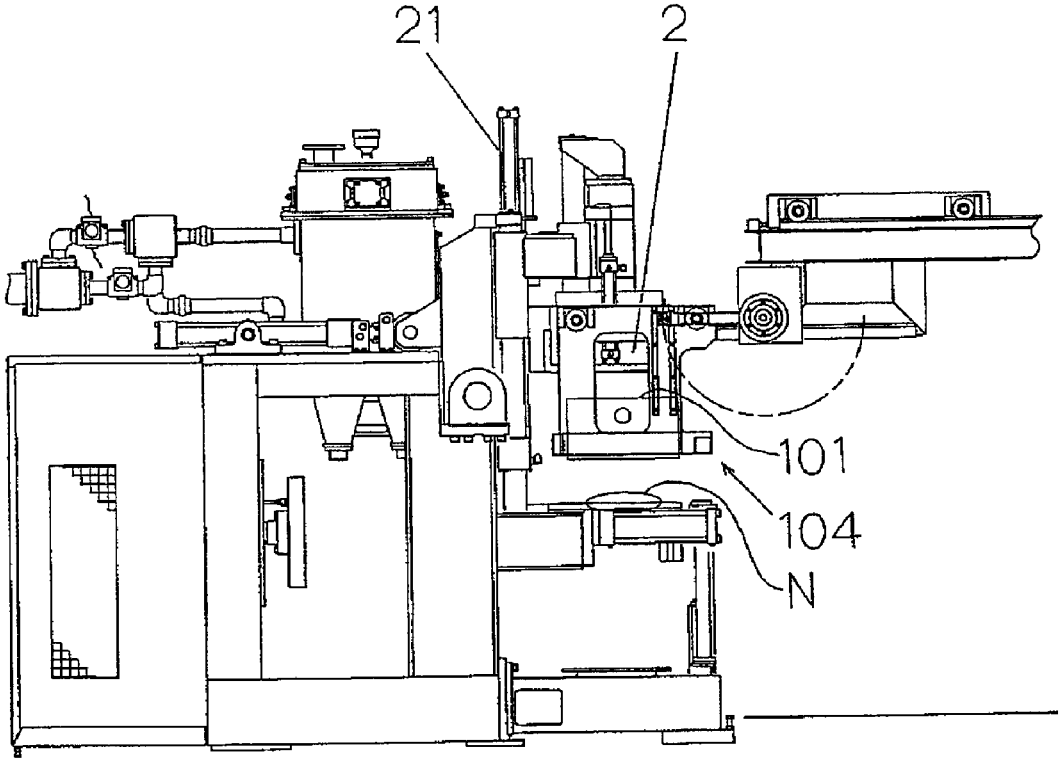

FIG. 10 is an elevational view of the core-setting apparatus, and shows that the carrier and the empty handling tool are lifted.

Figure 11:
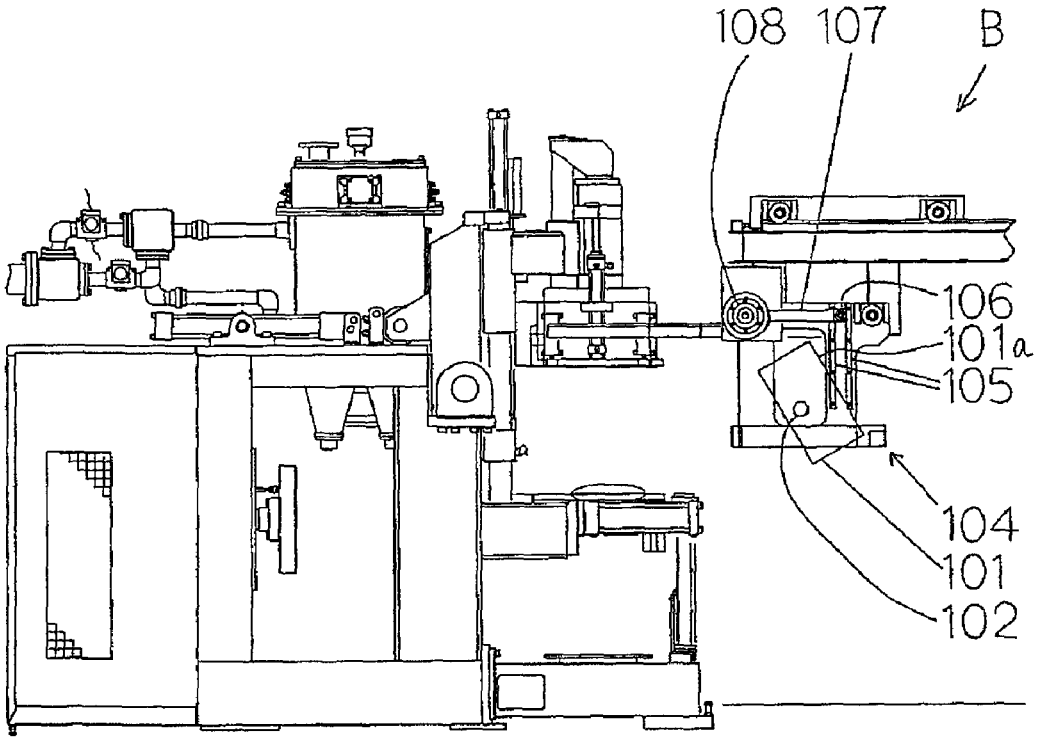

FIG. 11 is an elevational view of the core-setting apparatus, and shows that the carrier is removed from the position above the lower mold, and that the handling tool is located at an initial position.

Figure 12:
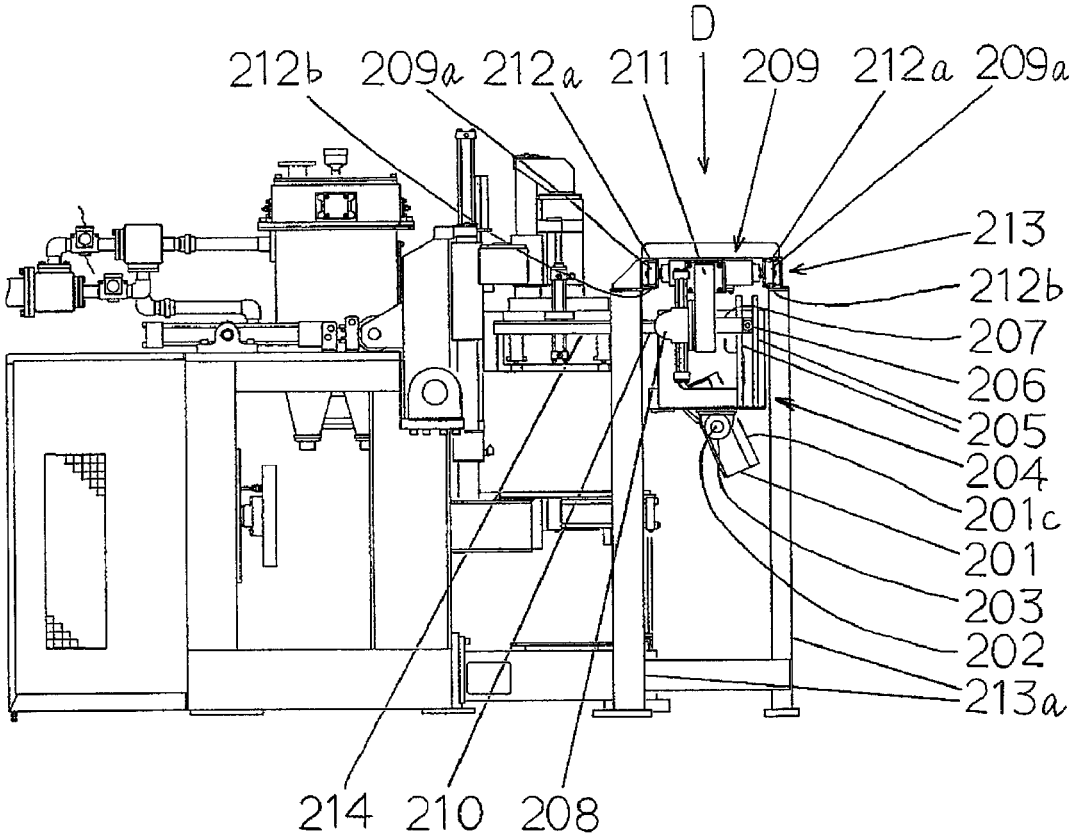

FIG. 12 is an elevational view of the core-setting apparatus of these inventions showing the second embodiment used for the molding apparatus.

Figure 13:
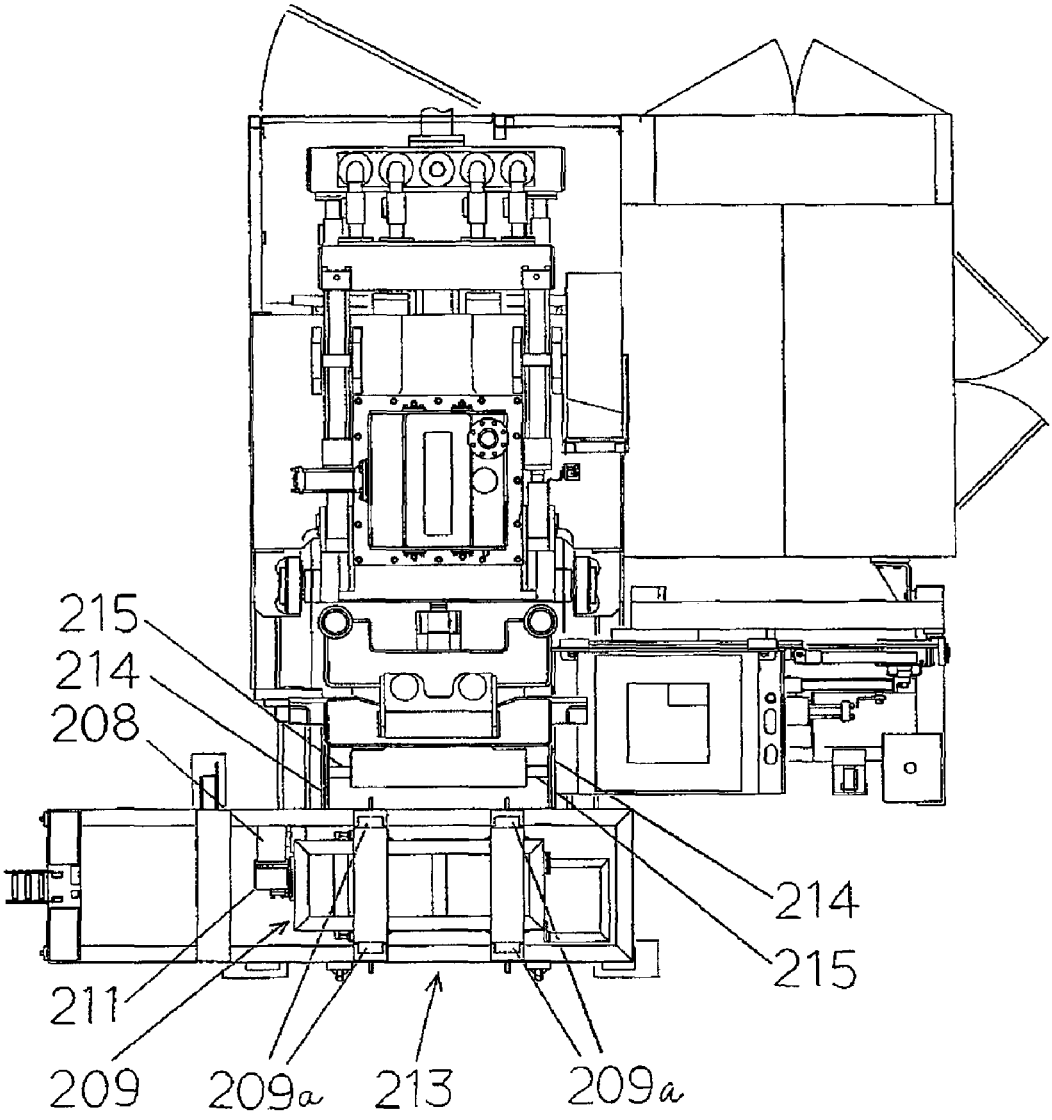
Figure 14:
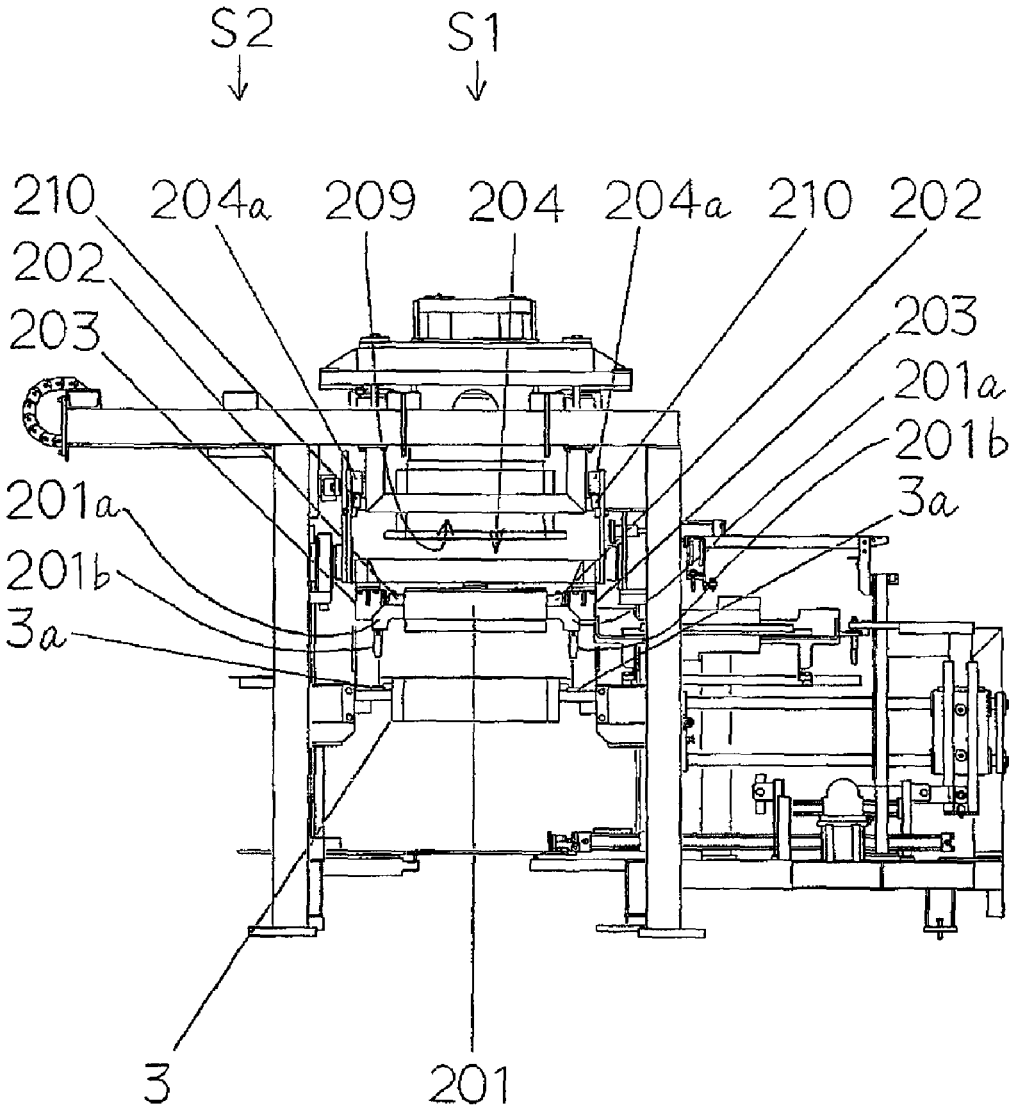

FIG. 13 is a plane view of FIG. 14. Part of FIG. 14 is omitted.

FIG. 14 is a view of the right side of FIG. 12. Part of FIG. 12 is omitted. FIG. 14 shows that the holding surface of the handling tool faces downward.

Figure 15:
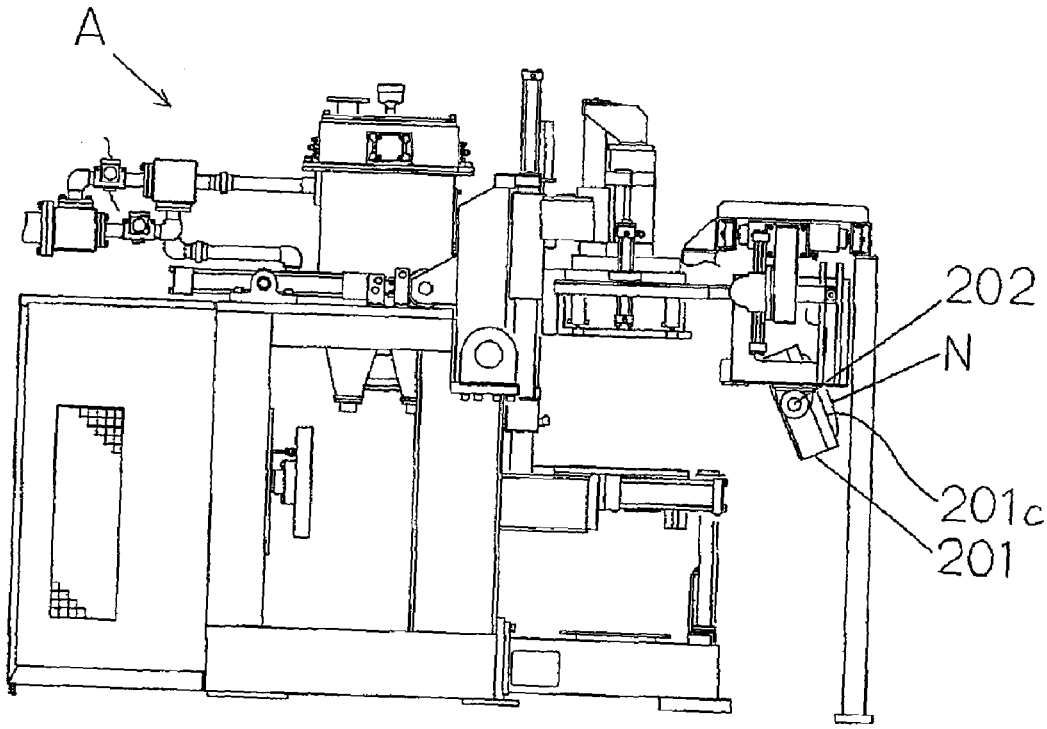

FIG. 15 is an elevational view of the core-setting apparatus. Part of it is omitted. FIG. 15 shows that the core is held in the handling tool, which is at an initial position.

Figure 16:
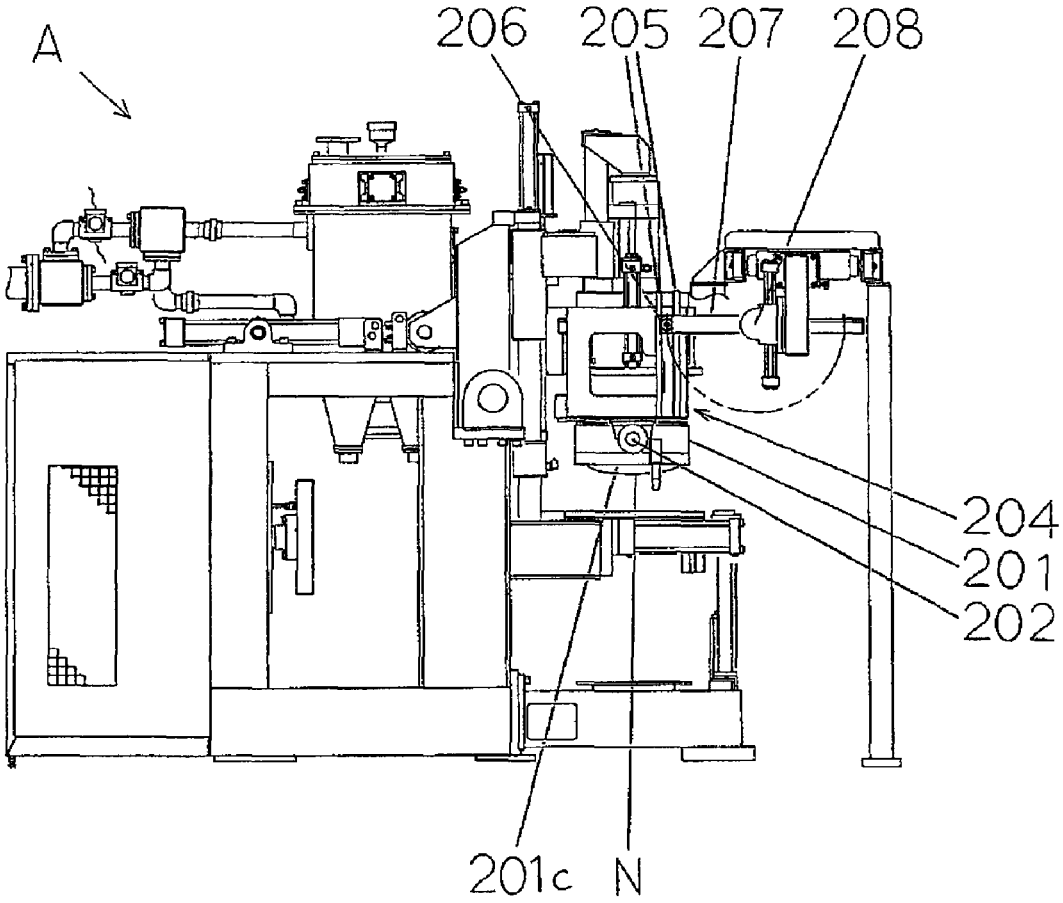

FIG. 16 is an elevational view of the core-setting apparatus. Part of it is omitted. FIG. 16 shows that the carrier is moved to a position above the lower mold, and that the core faces the lower mold.

Figure 17:
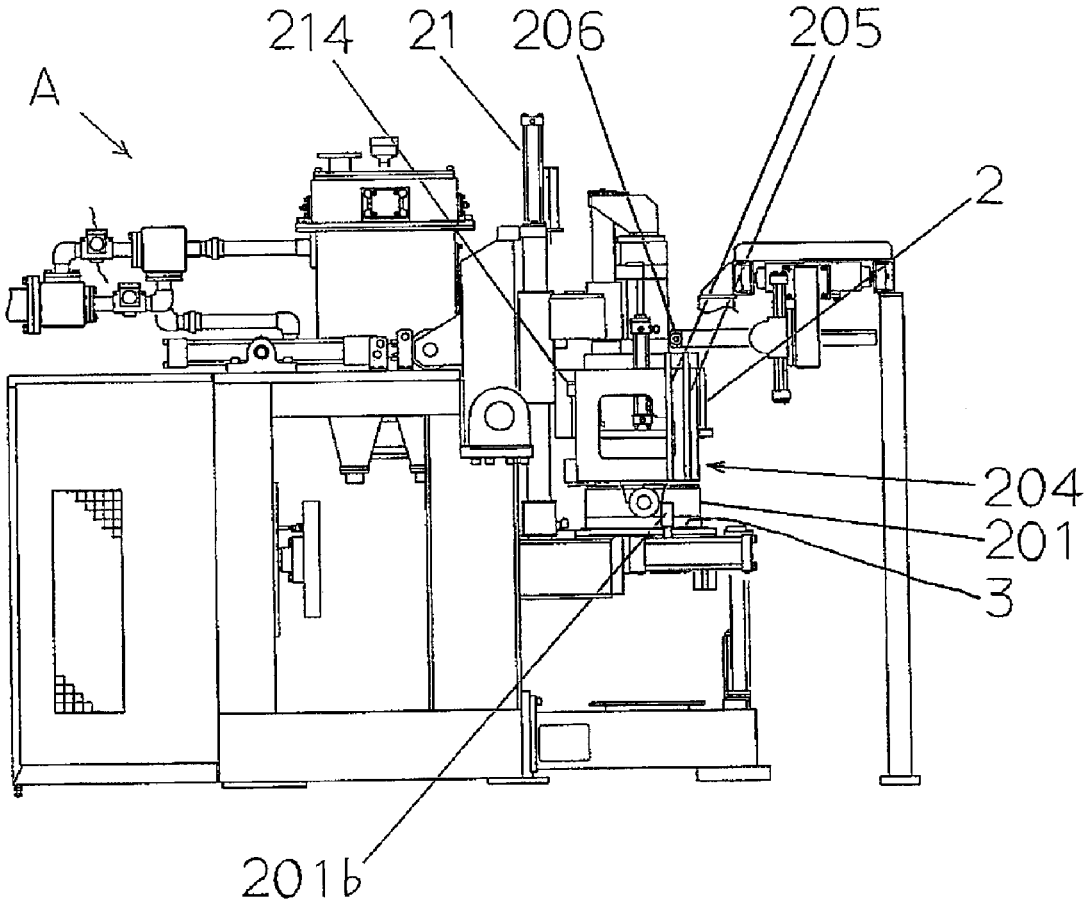

FIG. 17 is an elevational view of the core-setting apparatus. Part of it is omitted. FIG. 17 shows that the core is lowered to just in front of the surface of the lower mold.

Figure 18:
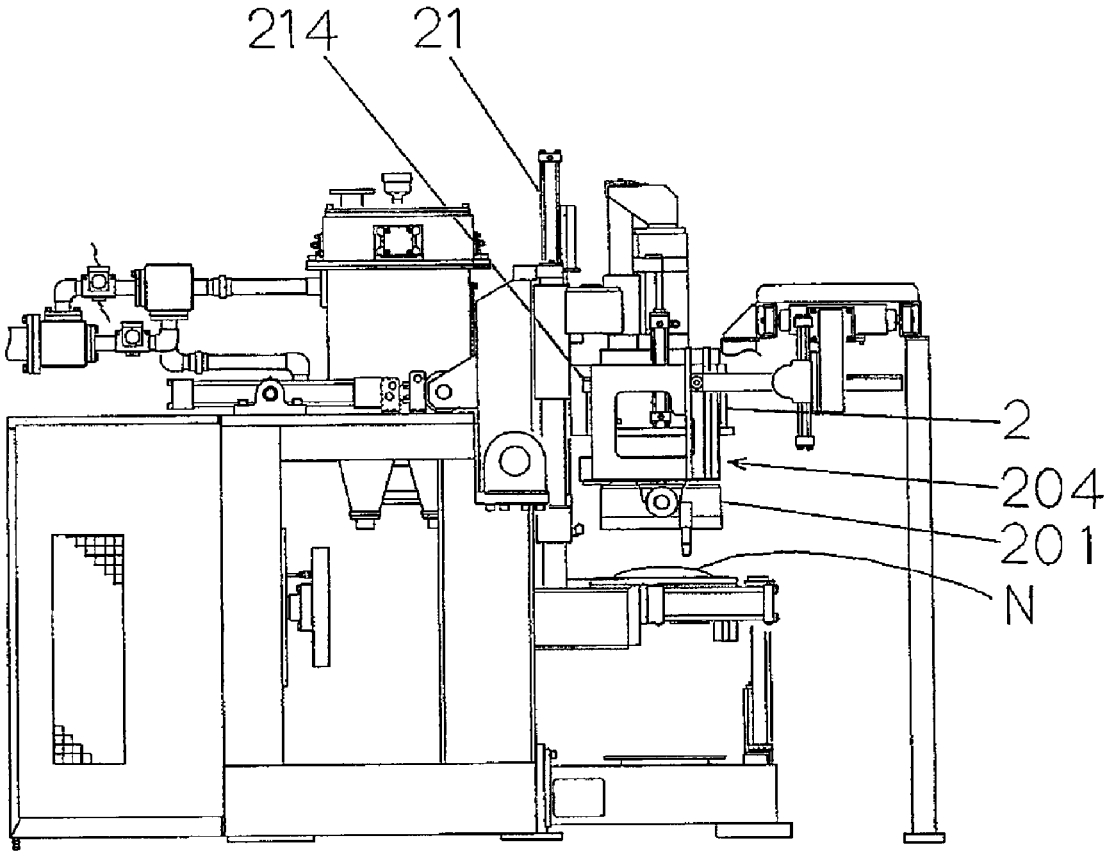

FIG. 18 is an elevational view of the core-setting apparatus. Part of it is omitted. FIG. 18 shows that the carrier and the empty handling tool are lifted.

Figure 19:
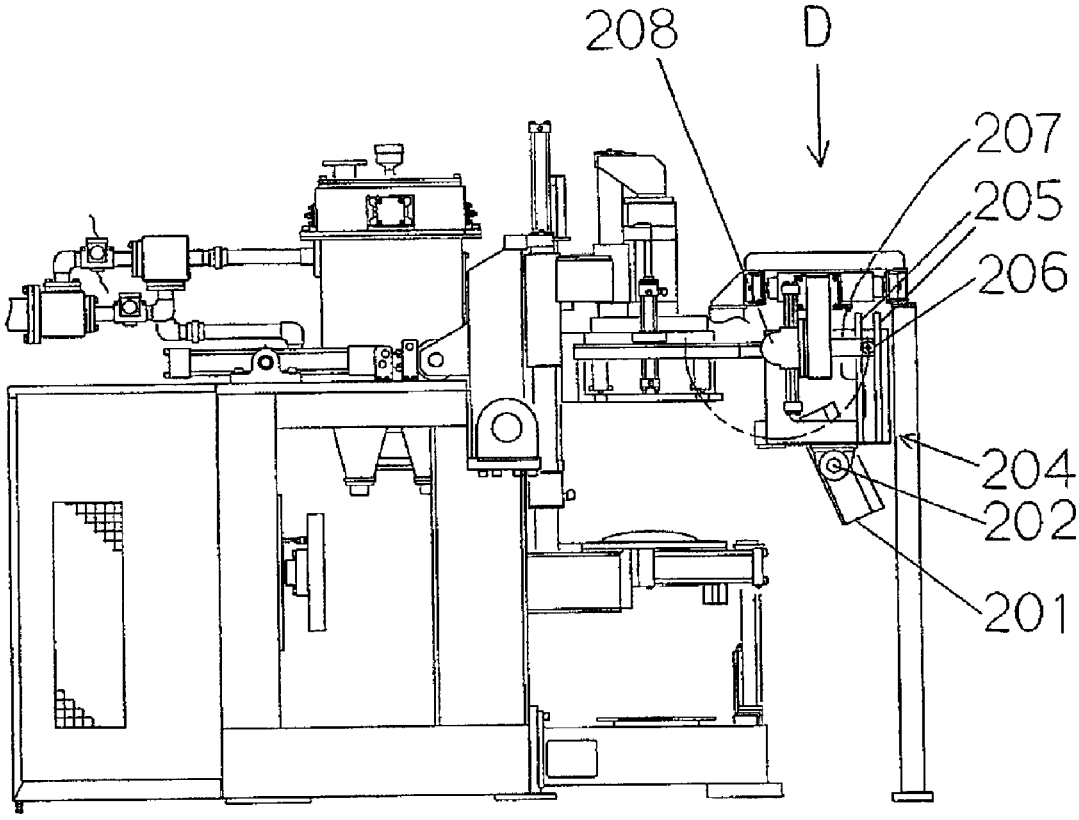

FIG. 19 is an elevational view of the core-setting apparatus. Part of it is omitted. FIG. 19 shows that the carrier is removed from the position above the lower mold, and that the handling tool is located at an initial position.

Figure 20:
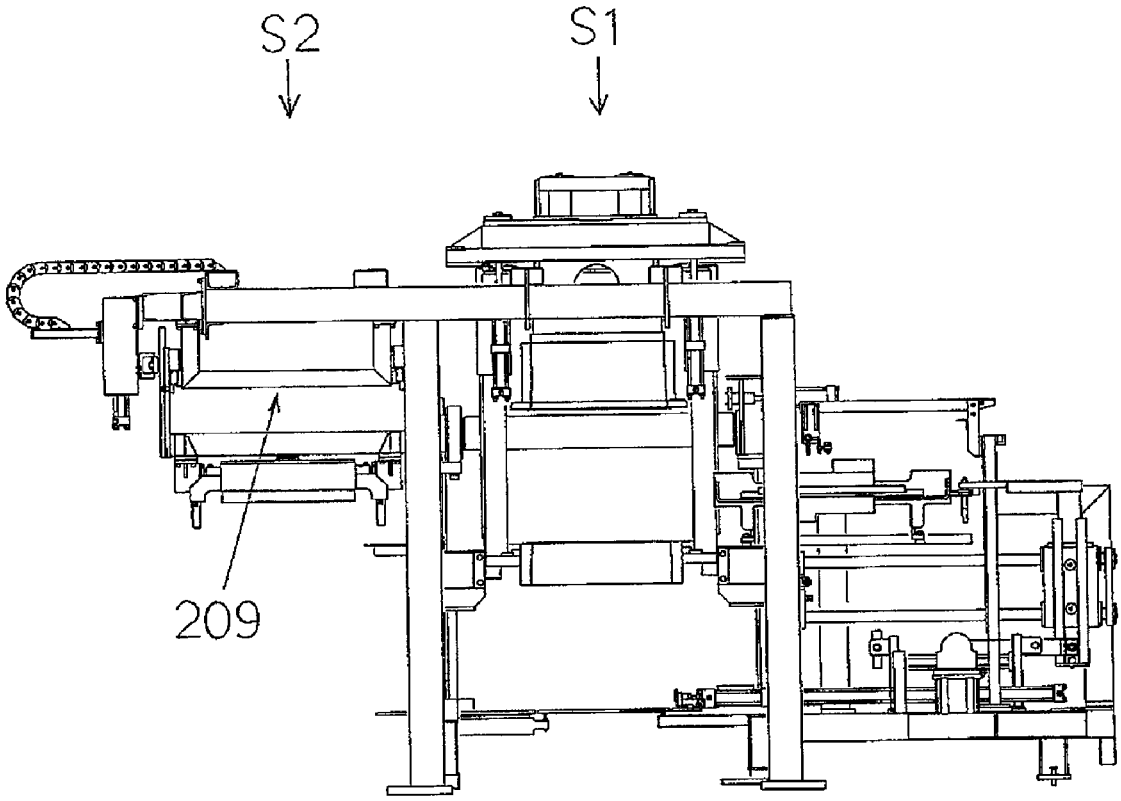

FIG. 20 is a view of the right side of FIG. 12. Part of FIG. 12 is omitted. FIG. 20 shows that the carriage is fixed to the position of the station S2, which station S2 is in a portion that does not operate.

PREFERRED EMBODIMENTS OF THE INVENTIONS

One embodiment of these inventions is now explained in detail based on the figures. As in FIG. 1, a main body A of a molding apparatus comprises:

a cope flask 2 and a drag flask 3, which can hold therebetween a match plate 1, having patterns 1*a*, 1*a*, at both its sides, an upper squeezing member 4, which is insertable into the opening positioned on the opposite side of the cope flask 2 from the match plate 1, a filling frame 6 perpendicularly fixed to a base 5, and a lower squeezing member 7, which is insertable in the filling frame 6, wherein the lower squeezing member 7 is disposed so that its pressurizing surface faces the horizontal direction.

Figure 1:
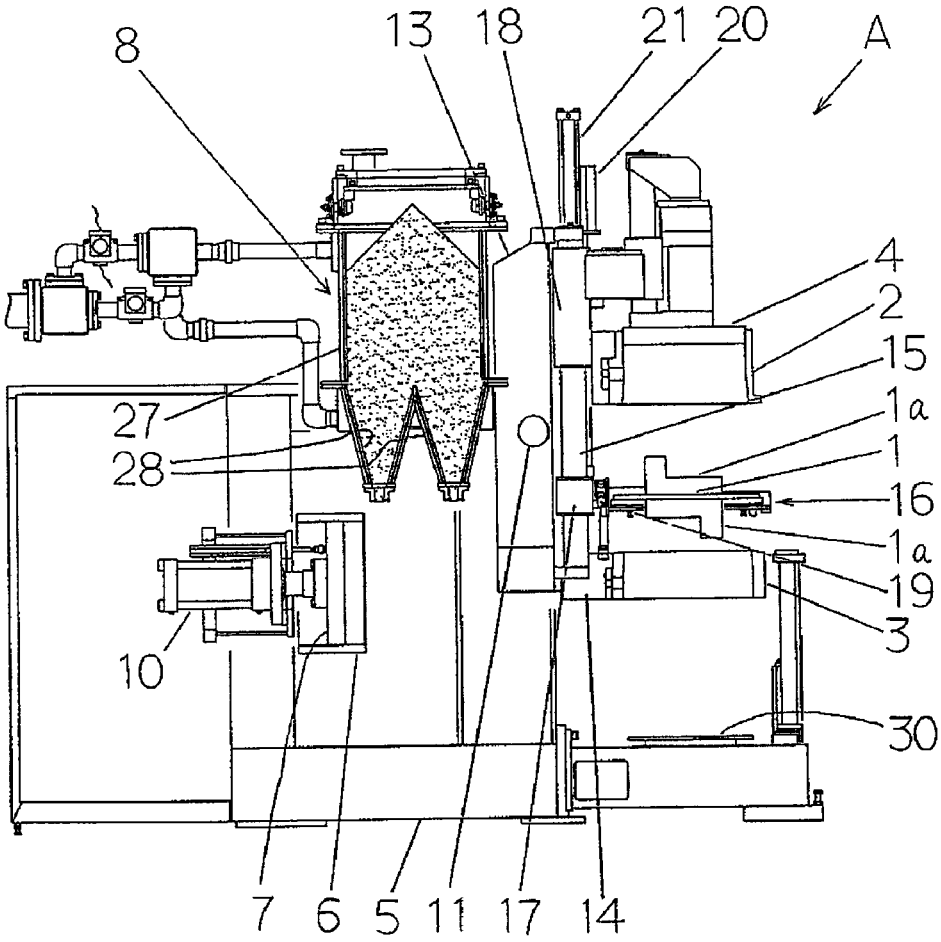
FIG. 1 is an elevational and a partial sectional view of the main structure of the molding apparatus.

FIG. 1 shows the main body A of the molding apparatus at the initial position. In this stage, the match plate 1, the cope flask 2, the drag flask 3, and the upper squeezing member 4 are disposed at the horizontal position, and the pressurizing surface of the upper squeezing member 4 faces perpendicularly downward. As explained below, the match plate 1, the cope flask 2, the drag flask 3, and the upper squeezing member 4 can be integrally rotated so that they are disposed at the perpendicular position.

In contrast, the filling frame 6 and the lower squeezing member 7 cannot rotate, and the pressurizing surface of the lower squeezing member 7 is fixed so that it faces horizontally. When the cope flask 2 and the drag flask 3 holding the match plate 1 therebetween are at the perpendicular position after they rotate, the filling frame 6 is disposed at the fixed position, which the drag flask comes in contact with. The lower squeezing member 7 is also insertable into the drag flask, which is at the perpendicular position, through the filling frame.

A sand-supplying mechanism 8, disposed at an upper-central portion of the main body A, fills molding spaces located below the sand-supplying mechanism 8 with molding sand. (Here, FIG. 1 does not show the molding spaces located below the sand-supplying mechanism 8.) A pair of first cylinders 9 (upper cylinders) horizontally extending (see FIGS. 2 and 3) and a second cylinder 10 (a lower cylinder) also horizontally extending (see FIG. 1) face each other and are disposed near a location below the sand-supplying mechanism 8. The respective cylinders drive the upper squeezing member 4 and the lower squeezing member 7. In this embodiment, the first and the second cylinder are each hydraulic. However, electrically-driven cylinders may be used.

As shown in FIGS. 1 and 2, a rotating shaft 11, disposed at the top-right side of the base 5, extends in the direction connecting the rear to the front of the main body A (perpendicular to the sheets showing FIGS. 1 and 2). Thus, FIGS. 1 and 2 show just the front-end surface of the rotating shaft 11. The rotating shaft 11 is rotatably supported by a pair of bearings 12 disposed at the base 5 with a predetermined interval in the direction connecting the rear to the front of the main body A (FIG. 2 shows only the front bearing 12). A rotating frame 13, extending substantially perpendicularly, is fixed to the rotating shaft 11 near the central portion in its longitudinal direction.

Especially, as shown in FIG. 1, the drag flask 3, which has a sand-filling port at its left side wall, is disposed at the right side and bottom end of the rotating frame 13 by means of a supporting member 14. A pair of guide rods 15, substantially extending perpendicularly, are disposed at the right side of the rotating frame 13 with a predetermined interval in the direction connecting the rear to the front of the main body A (FIGS. 1 and 3 show only the front guide rod 15).

Further, as shown in FIG. 1, a retaining member 16, which retains the match plate 1 above the drag flask 3, is slidable and is supported by the pair of the guide rods 15 perpendicularly extending by means of a guide holder 17. The cope flask 2, which has a sand-filling port at its left side wall, is also slidable and is supported above the retaining member 16 by means of another guide holder 18. Further, the retaining member 16 is supported by guide rails 19 extending in the direction connecting the rear to the front of the molding apparatus so that it can move along the guide rails 19. The guide rails 19 can ascend and descend by extending and contracting a third cylinder 20 disposed at the rotating frame 13. The cope flask 2 is connected to a fourth cylinder 21, which extends downwardly, through a support structure (not shown). The distal end of the piston rod of the fourth cylinder 21 is connected to the rotating frame 13. The cope flask can move forward to and backward from the retaining member 16 by extending and contracting a fourth cylinder 21.

Especially, as shown in FIG. 2, a pair of fifth cylinders 22 is disposed at the central portions of the front and the rear side surface of the cope flask 2 (only the front side surface of the cope flask 2 is shown in FIG. 2). The upper squeezing member 4 connects the distal ends of the piston rods of the pair of the fifth cylinders 22 so that the cylinders 22 can move the upper squeezing member 4 forward to or backward from the cope flask 2 by their extending and contracting motions. Thus, the pair of the fifth cylinders 22 can be rotated together with the cope flask 2 and the upper squeezing member 4. Two pairs of sixth cylinders 23, downwardly extending, are disposed at the right and left ends of the front and the rear side surface of the cope flask 2 so that the cylinders 23 can move the match plate 1 away from the cope flask 2. Four seventh cylinders 24 (see FIG. 2), upwardly extending, are disposed at the front and the rear side surface of the drag flask 3 (see FIG. 1) so that the cylinders 24 can move the match plate 1 away from the drag flask 3. In addition, since the third cylinder 20 can be used as a substitute for two of the four seventh cylinders 24, two cylinders 24 can be omitted. A pair of eighth cylinders 25 extending rightward is disposed at the front and the rear side of the upper surface of the base 5. The upper portion of the rotating frame 13 connects the distal ends of the piston rods of the pair of the eighth cylinders 25 through a connecting mechanism 26. The rotating frame 13 can rotate about the rotating shaft 11 by extending and contracting the eighth cylinders 25.

As shown in FIG. 2, the sand-supplying mechanism 8 of the main body A is disposed between the pair of the eighth cylinders 25 at the upper surface of the base 5. As shown in FIG. 1, an aeration mechanism 28 for ejecting compressed air to fluidize molding sand is disposed below the sand-tank 27 of the sand-supplying mechanism 8.

FIG. 5, a plane view, and FIG. 6, an elevational view, show the match plate 1, the cope and the drag flask 2, 3, the upper and the lower squeezing member 4, 7, and the filling frame 6, which are positioned just under the sand-supplying mechanism 8 by rotating them together with related members from the position in FIGS. 1 and 2 after defining the upper and the lower molding space as explained above. As in FIGS. 5 and 6, a supporting frame 29 (see FIG. 5), having a C-like shape in the sectional plane view, is fixed to the base 5 (see FIGS. 1 and 2) below the sand-supplying mechanism 8 (see FIG. 6).

Especially, as shown in FIG. 5, the filling frame 6, which is positioned perpendicularly, is disposed at the inner left side of the supporting frame 29, so that the filling frame 6 comes into contact with the drag flask 3 when the lower molding space is defined. The second cylinder 10, horizontally extending to the right, is disposed at the central portion of the left frame of the supporting frame 29. The distal end of the piston rod of the cylinder 10 is fixed to the lower squeezing member 7. The lower squeezing member 7 is in a perpendicular position. Each of the first cylinders 9, horizontally extending to the left, is disposed at the pair of the open ends of the supporting frame 29.

Next, a core-setting apparatus B is explained. A handling tool 101 is provided with and is rotatably supported by a rotatable rod 102. The rotatable rod 102 is also rotatably supported by a carrier 104, which is used for transferring the handling tool 101, by means of bearings 103, 103 (see FIG. 4) disposed at both its ends. Here, the rotatable rod 102 can be rotated by a driving motor. (not shown)

The portion of contacting the core of the handling tool 101 is made from resin, and is designed so that it can be changed (not shown). Further, the handling tool 101 is provided with a holding means (not shown) to hold the core. In this embodiment, a vacuuming means is used for holding the core and acts as the holding means. The holding means is not limited to the vacuuming means. For example, a clamping means to mechanically clamp the core can also be used for the holding means.

The carrier 104 for transferring the handling tool is provided with four rollers 104*a*, 104*a* disposed at the upper portion of its inside. A pair of guide members 105, 105 (see FIGS. 2 and 3) is fixed to the front side of the carrier 104 at a predetermined interval. A roller 106 is slidably disposed between the pair of the guide members 105, 105. Further, the roller 106 is disposed at an arm 107. The arm 107 is connected to a rotating shaft of a motor 108, explained below.

A carriage 109 is disposed over the carrier 104 and provided with four rollers 109*a*, 109*a* disposed at the upper portion of the outside of the carriage 109. A pair of horizontally movable rails 110, 110 is fixed to the lower portion of the outside of the carriage 109. The rails can move horizontally together with the carriage 109. The rollers 104*a*, 104*a* of the carrier 104 are disposed on the pair of the horizontally movable rails 110, 110. Further, the motor 108 is disposed at the lower portion of the front side of the carriage 109 and is fixed to the carriage 109 by means of a supporting member 111.

The rollers 109*a*, 109*a* of the carriage 109 are disposed on rails 112, 112, which are located under the rollers 109*a*, 109*a*. The rails 112, 112 are supported by being fixed to supporting frames 113. Here, the frames 113 are supported by columns (not shown). A pair of perpendicularly movable rails 114, 114 is fixed to two of the outer sides of the cope flask 2 in the main body A of the molding apparatus through fixing members 115, 115 (see FIG. 3) so that the rails 114, 114 can perpendicularly move together with the cope flask 2. Thus, the carrier 104 and the handling tool 101 can perpendicularly move together with the cope flask 2 by moving the carrier 104 and the handling tool 101 to a position above the drag flask 3 through the perpendicularly movable rails 114, 114. Here, when the cope flask is located at the highest position, the upper surfaces of the perpendicularly movable rails 114, 114 correspond to those of the horizontally movable rails 110, 110.

"C" denotes a transferring mechanism to transfer the match plate 1 between the cope flask 2 and the drag flask 3 together with the retaining member 16. "30" denotes a receiving member that is used for placing an upper and a lower mold that is stripped from the cope flask 2 and the drag flask 3. Further, "31" denotes a cylinder for pushing the upper and the lower mold placed on the receiving member 30 out from it.

Below, the operations of the apparatus having the constitution explained in the above paragraphs are explained. From the state shown in FIG. 1, the match plate 1 is held between the cope flask 2 and the drag flask 3 by sequentially stacking the drag flask 3, the match plate 1, and the cope flask 2 in a substantially horizontal condition by contracting the fourth cylinder 21 of the main body A, which cylinder extends downward.

Next, while the first cylinders 9 of the main body are contracted, the rotating frame 13 is rotated clockwise about the rotating shaft 11 by extending the pair of the eighth cylinders 25 of the main body A. As a result of this operation, the upper squeezing member 4 is transferred between the first cylinders 9 and the filling frame 6 together with the cope flask 2 and the drag flask 3 holding the match plate 1 and located at the perpendicular position. At the same time that the rotating frame 13 rotates, the upper and the lower molding space shown in FIG. 5 start to be defined by extending the second cylinder 10 at a predetermined length, and by contracting the pair of the fifth cylinders 22. For more detail, note that while the match plate 1 is held between the cope flask 2 and the drag flask 3, the upper molding space is defined by inserting the upper squeezing member 4 into the cope flask 3 from its side opposite the match plate 1. Since the cope flask 2 and the drag flask 3 holding the match plate 1, the upper squeezing member 4, and the fifth cylinders 22 for moving the upper squeezing member 4 can all be rotated together, during the rotation of the rotating frame 13 the upper molding space can be defined. Further, when the rotating frame 13 is rotating, the lower squeezing member 7 is inserted into the drag flask 3 through the filling frame 6. The flask 3 is moved near the filling frame 6 and is placed in the substantially perpendicular position by the rotation of the rotating frame 13. After the rotation of the rotating frame 13 is completed, the lower molding space is also defined by contacting the drag flask 3 to the filling frame 6.

Next, the upper and the lower molding space are filled with the molding sand by supplying compressed air into the aeration mechanism 28 of the sand-tank 27 from a source of compressed air (not shown). When the molding spaces are filled with the molding sand, it is preferable to supply compressed air in the sand-tank 27 so as to shorten the time for filling the molding space with the molding sand. However, these inventions are not limited by these configurations.

Next, the molding sand in the upper and the lower molding space is squeezed by respectively moving the upper and lower squeezing members 4, 7 toward the match plate 1 by respectively extending the first cylinders 9 and the second cylinder 10. By these squeezing operations, the upper and the lower mold is respectively produced in the upper and the lower molding space.

Then, the cope flask 2 and the drag flask 3, which respectively include the upper and lower mold in the flasks, are rotated and moved by the counterclockwise rotation of the rotating frame 13 by contracting the eighth cylinders 25.

Next, the cope flask 2 is lifted by extending the fourth cylinder 21. Then the match plate 1 is pushed down from the cope flask 2 by extending the sixth cylinders 23. At the same time, the match plate 1 is pushed up from the drag flask 3 by the seventh cylinders 24.

Then, the match plate 1 is removed from between the cope flask 2 and the drag flask 3 together with the retaining member 16 by driving the transferring mechanism C. When the state shown by FIG. 2 is achieved, the operations for setting a core in the mold start. Below, these operations are explained in detail. First, after the horizontally movable rails 110, 110 are contacted by the perpendicularly movable rails 114, 114 by manually moving the carrier 104 and the carriage 109 forward, the carriage 109 is fixed to the position by a fixing means (not shown).

Next, after setting a core N on the holding surface 101*a* of the handling tool 101 that is at an initial state, namely, the handling tool 101 is inclined at a predetermined angle (in this embodiment, the angle is 30 degrees) by rotating it about the rotatable rod 102 so that the top of the handling tool 101 moves backward (toward the main body A), the core N is held in the handling tool 101 by suctioning it by driving the vacuuming means. (See FIG. 7.)

Then, the arm 107 is rotated 180 degrees so that it moves toward the main body A by driving the motor 108. As a result of this operation, the roller 106 slidably reciprocates between the pair of the guide members 105, 105, and the carrier 104 moves to above the lower mold. When the carrier 104 begins to move toward the main body A, simultaneously the handling tool is rotated (in FIG. 7, clockwise) so that the core N faces downward by driving the motor for rotating the rotatable rod 102. As a result of these operations, since while the carrier 104 is transferred to above the lower mold the holding surface 101*a* of the handling tool 101 faces downward, the core N, held by the handling tool, faces toward the lower mold. (See FIG. 8.)

Then an actuator for lifting and lowering the cope flask 2, which actuator is mounted on the main body A, is driven. The actuator can lift and lower the cope flask 2 together with the handling tool 101 and the carrier 104, which are transferred to above the lower mold. Namely, the perpendicularly movable rails 114, 114 are lowered together with the cope flask 2 by contracting the fourth cylinder 21. As a result of these operations, the core N, held by the handling tool 101 disposed at the carrier 104, is lowered to just in front of the surface of the lower mold (in this embodiment, the clearance between the core N and the surface of the lower mold is 1 mm). (See FIG. 9.) After the core N is lowered, it is released from the handling tool 101 by stopping the vacuuming means and is set in the lower mold.

Next, the perpendicularly movable rails 114, 114 are lifted by inversely driving the actuator together with the cope flask 2, namely, by extending the fourth cylinder 21. Thus, the carrier 104 and the vacant handling tool 101 are also lifted. (See FIG. 10.)

Then, the arm 107 is rotated 180 degrees so that it moves toward the core-setting apparatus B by inversely driving the motor 108. As a result of this operation, the roller 106 slidably reciprocates between the pair of the guide members 105, 105, and the carrier 104 is removed from above the lower mold. When the carrier 104 begins to move toward the core-setting apparatus B, simultaneously the handling tool 101 is inversely rotated (in FIG. 10, counterclockwise) so that the handling tool returns to the initial position, explained previously, by inversely driving the motor for rotating the rotatable rod 102. As a result of these operations, while the carrier 104 is removed from above the lower mold, the handling tool 101 is placed at the initial position. (See FIG. 11.)

In the main body A, the cope flask 2 is lowered and stacked on the drag flask 3 by contracting the forth cylinder 21. Then the upper surface of the receiving member 30 is contacted by the bottom surface of the lower mold by driving a lifting and lowering cylinder (not shown). Next, the upper squeezing member 4 pushes down the upper mold in the cope flask 2 by contracting the fifth cylinders 22. Then, the upper and lower molds are stripped from the cope flask 2 and the drag flask 3 by lowering the receiving member 30 by driving the lifting and lowering cylinder (not shown). Next, the upper squeezing member 4 is lifted by extending the fifth cylinders 22. Then, the upper and lower molds that are placed on the receiving member 30 are pushed out from it by extending the cylinder 31 for pushing the molds. As a result of a series of these operations, a flaskless upper mold and a flaskless lower mold can be produced.

Incidentally, for the next operations for producing another pair of molds, if it is necessary to set a core in the molds then the carriage 109 is kept at the forward position. In contrast, when molds that need no core are to be produced, namely, if it is unnecessary to set a core in the molds, the carrier 104 and the carriage 109 are manually moved backward by releasing the fixing means for the carriage 109.

For the present inventions, the handling tool 101 is transferred to the space between the cope flask 2 and drag flask 3 so that the core N faces downward, wherein the space is used for inserting and holding the match plate 1. Then the core N is set in the lower mold in the main body A of the molding apparatus, which main body has a high stiffness and a high dimensional accuracy. These operations are similar to the operations for holding the match plate 1 between the cope flask 2 and the drag flask 3. In contrast, in the prior art, a core is set in a lower mold by lifting a drag flask while it is drawn out from a molding apparatus. Namely, it is cantilevered. Thus, in comparison with the prior art, by the present inventions the core in the mold can be held very accurately. Further, for the present inventions, the core is set in the lower mold in an operation similar to that where the match plate 1 is held between the cope flask 2 and the drag flask 3. Thus, since there is no need to constitute the molding apparatus so that the drag flask is movable forward and backward, a molding apparatus that has a simple structure can be provided.

For the embodiment of these inventions, the carrier 104 and the carriage 109 are manually moved forward and backward. However, these inventions are not limited to this embodiment. It is also possible to use an actuator (say, a cylinder or a motor) for moving them forward and backward.

Further, for the embodiment of these inventions, the core N, held in the handling tool 101 disposed at the carrier 104, is lowered to just in front of the surface of the lower mold. However, these inventions are not limited to this embodiment. It is also possible to lower the core N until it contacts the surface of the lower mold.

Further, for the embodiment of these inventions, after the core N, held by the handling tool 101 disposed at the carrier 104, is lowered to just in front of the surface of the lower mold (or until it contacts that surface), the core N is released from the handling tool 101 by stopping the vacuuming means, and is then set in the lower mold. However, these inventions are not limited to this embodiment. It is more preferable that the core N be set in the lower mold by pressurizing the core N with compressed air after stopping the vacuuming means, because the core N can be definitely released from the handling tool, and so any possible trouble in releasing the core N from the handling tool can be prevented. Incidentally, a vacuuming and pressurizing means can be used for the holding means instead of the vacuuming means alone, to pressurize the core N with the compressed air.

Further, for the embodiment of these inventions, the handling tool 101 is rotated by rotating the rotatable rod 102 by the driving motor (not shown). However, these inventions are not limited to this embodiment. Also an arm can be attached to one end of the rotatable rod 102 so that the rod 102 can be rotated by driving a cylinder connected to the distal end of the arm. Further, a cam mechanism can be used for rotating the rotatable rod 102, instead of the actuator.

Further, for the embodiments of these inventions, after the horizontally movable rails 110, 110 are contacted by the perpendicularly movable rails 114, 114 by moving the carrier 104 and the carriage 109 forward, the carriage 109 is fixed to its position by a fixing means (not shown). However, these inventions are not limited to this embodiment. Also, the carriage can be positioned so that a little clearance (for example, 1 mm) between the horizontally movable rails 110, 110 and the perpendicularly movable rails 114, 114 can be maintained.

Below, a second embodiment of a molding apparatus that differs from the embodiment (defined as the first embodiment) explained in the above paragraphs is explained. For the second embodiment of the molding apparatus, only a part of the constitution of the core-setting apparatus differs from that of the core-setting apparatus B of the first embodiment. Namely, the main body A and the transferring mechanism C, to transfer the match plate of the molding apparatus of the second embodiment, have the same constitutions as those of the first embodiment. Based on the figures, the second embodiment of the apparatus is explained in detail. For the second embodiment, the core-setting apparatus is denoted as "D" to distinguish it from the core-setting apparatus B of the first embodiment. Except for the core-setting apparatus D, the explanation of the elements of the second embodiment that are the same as those of the first embodiment, which elements have the same denotations as those of the first embodiment, is omitted.

Now the constitution of the core-setting apparatus D is explained. As shown in FIG. 12, a handling tool 201 is provided with and is rotatably supported by a rotatable rod 202. The rotatable rod 202 is also rotatably supported by a carrier 204, which is used for transferring the handling tool 201, by means of bearings 203, 203 (see FIG. 14) disposed at both its ends. Here, the rotatable rod 202 can be rotated by a driving motor (not shown).

The portion contacting the core of the handling tool 201 is made from resin, and is designed so that it can be changed (not shown). Further, the handling tool 201 is provided with a holding means (not shown) to hold the core. In the second embodiment, a vacuuming means is used for holding the core and acts as the holding means. The holding means is not limited to the vacuuming means. For example, a clamping means to mechanically clamp the core can also be used for the holding means.

The carrier 204 for transferring the handling tool is provided with four rollers 204*a*, 204*a* disposed at the upper portion of its inside (see FIG. 14; two rollers of the front side of the carrier are depicted). A pair of guide members 205, 205 (see FIG. 12) is fixed to the front side of the carrier 204 at a predetermined interval. A roller 206 is slidably disposed between the pair of the guide members 205, 205. Further, the roller 206 is disposed at an arm 207. The arm 207 is connected to a rotary actuator 208.

A carriage 209 is disposed over the carrier 204 and provided with four rollers 209*a*, 209*a* disposed at the upper portion of the outside of the carriage 209 (see FIG. 12; two rollers of the front side of the carriage are depicted in FIG. 12). A pair of horizontally movable rails 210, 210 is fixed to the lower portion of the outside of the carriage 209 (see FIG. 14). The rails can move together horizontally with the carriage 209. The rollers 204*a*, 204*a* of the carrier 204 are disposed on the pair of the horizontally movable rails 210, 210. Further, a supporting member 211 is disposed at the upper portion of the front side of the carriage 209. The rotary actuator 208 is fixed to the supporting member 211.

The rollers 209*a*, 209*a* of the carriage 209 are disposed on rails 212*b*, which are located under the rollers 209*a*, 209*a*, so that the rollers 209*a*, 209*a* can move between the rails 212*a*, 212*b*, which rails 212*a* are located above the rollers 209*a*, 209*a*. The rails 212*a*, 212*b* are supported by being fixed to supporting frames 213 that are supported by means of columns 213*a*. To be easily understandable, in FIGS. 15-19 the columns 213*a* that face the main body A of the molding apparatus are omitted.

A pair of perpendicularly movable rails 214, 214 is fixed to the two respective outer sides of the cope flask 2 in the main body A of the molding apparatus by means of fixing members 215, 215 (see FIG. 13) so that the rails 214, 214 can move perpendicularly together with the cope flask 2. Thus, the carrier 204 and the handling tool 201 can move perpendicularly together with the cope flask 2 by moving the carrier 204 and the handling tool 201 to a position above the drag flask 3 by means of the perpendicularly movable rails 214, 214. Here, when the cope flask 2 is located at the highest position, the upper surfaces of the perpendicularly movable rails 214, 214 correspond to those of the horizontally movable rails 210, 210.

As shown in FIG. 14, positioning pins 201*b*, 201*b* are both disposed outside of the handling tool 201 by means of attachments 201*a*, 201*a*. Positioning members 3*a*, 3*a* are disposed at the drag flask 3. The members have positioning holes (not shown) in which the positioning pins 201*b*, 201*b* are inserted.

The carriage 209 of the core-setting apparatus D can be manually moved between a station S1 for setting a core and a station S2, which station S2 is in a portion that does not operate (see FIG. 14). When a core is set in a mold, after the carriage 209 is manually moved to the station S1 for setting the core, the carriage 209 is usually fixed to the position of the station S1 by means of a locking means (not shown), which is disposed at the station S1. When the carriage 209 is fixed to the station S1 for setting the core, small gaps (for example, 1 mm wide) between the perpendicularly movable rails 214, 214 and the horizontally movable rails 210, 210 can be retained.

Below, the operations of the apparatus having the constitution explained in the above paragraphs are explained. After an upper and lower mold are molded in the flasks, the cope flask 2 and the drag flask 3 and the match plate 1 are separated. Then the match plate 1 is removed from the position between the cope flask 2 and the drag flask 3, as shown in FIG. 12. Since the operations of the apparatus up to the status shown in FIG. 12 are the same as those of the first embodiment, the explanation for the operations is omitted.

From the status shown in FIG. 12, the operations for setting a core in a mold are started. These operations are now explained in detail. FIG. 12 shows the state in which the carriage 209 is fixed to the position of the station S1 by means of the locking means (not shown) disposed at the station S1. In this state, the handling tool 201 is at an initial state, namely, it is inclined at a predetermined angle (in this embodiment, the angle is 30 degrees) by rotating it about the rotatable rod 202 so that the top of the handling tool 201 moves backward (toward the main body A). At this status, after setting a core N on the holding surface 201*c* of the handling tool 201, the core N is held in the handling tool 201 by suctioning it by driving the vacuuming means. (See FIG. 15.)

Then, the arm 207 is rotated 180 degrees so that it moves toward the main body A by driving the rotary actuator 208. As a result of this operation, the roller 206 slidably reciprocates between the pair of the guide members 205, 205, and the carrier 204 moves to a position above the lower mold. When the carrier 204 begins to move toward the main body A, simultaneously the handling tool 201 is rotated (in FIG. 15, clockwise) so that the core N faces downward by driving the motor for rotating the rotatable rod 202. As a result of these operations, since while the carrier 204 is transferred to above the lower mold the holding surface 201*c* of the handling tool 201 faces downward, the core N, held by the handling tool 201, faces toward the lower mold. (See FIG. 16.)

Then the actuator for lifting and lowering the cope flask 2, which actuator is mounted on the main body A, is driven. The actuator can lift and lower the cope flask 2 together with the handling tool 201 and the carrier 204, which are transferred to a position above the lower mold. Namely, the perpendicularly movable rails 214, 214 are lowered together with the cope flask 2 by contracting the fourth cylinder 21. As a result of these operations, the core N, which is held by the handling tool 201 disposed at the carrier 204, is lowered to just in front of the surface of the lower mold (in this embodiment, the clearance between the core N and the surface of the lower mold is 1 mm). (See FIG. 17.) After the core N is lowered, it is released from the handling tool 201 by stopping the vacuuming means, and is then set in the lower mold.

When the carrier 204 and the handling tool 201 are lowered to just in front of the surface of the lower mold, the roller 206 is disengaged from the position between the pair of the guide members 205, 205. However, since the positioning pins 201*b*, 201*b*, both disposed outside of the handling tool 201, are respectively inserted into the positioning holes (not shown) of the positioning members 3*a*, 3*a* (see FIG. 14) disposed at the drag flask 3, the relative position of the handling tool 201 and the drag flask 3 can be adjusted.

Next, the perpendicularly movable rails 214, 214 are lifted by inversely driving the actuator together with the cope flask 2, namely, by extending the fourth cylinder 21. Thus, the carrier 204 and the vacant handling tool 201 are also lifted.

(See FIG. 18.) As a result of this operation, the roller 206 that has been disengaged from the position between the pair of the guide members 205, 205 is again inserted into the position between them. (See FIG. 18.)

Then, the arm 207 is rotated 180 degrees so that it moves toward the core-setting apparatus D by inversely driving the rotary actuator 208. As a result of this operation, the roller 206 slidably reciprocates between the pair of the guide members 205, 205, and the carrier 204 is removed from above the lower mold. When the carrier 204 begins to move toward the core-setting apparatus D, simultaneously the handling tool 201 is inversely rotated (in FIG. 18, counterclockwise) so that the handling tool 201 returns to the initial position, explained previously, by inversely driving the motor for rotating the rotatable rod 202. As a result of these operations, while the carrier 204 is removed from above the lower mold, the handling tool 201 is placed at the initial position. (See FIG. 19.)

In the main body A, the cope flask 2 is lowered and stacked on the drag flask 3 by contracting the fourth cylinder 21. Then the upper surface of the receiving member 30 is contacted by the bottom surface of the lower mold by driving a lifting and lowering cylinder (not shown). Next, the upper squeezing member 4 pushes down the upper mold in the cope flask 2 by contracting the fifth cylinders 22. Then, the upper and lower molds are stripped from the cope flask 2 and the drag flask 3 by lowering the receiving member 30 by driving the lifting and lowering cylinder (not shown). Next, the upper squeezing member 4 is lifted by extending the fifth cylinders 22. Then, the upper and lower molds that are placed on the receiving member 30 are pushed out from it by extending the cylinder 31 for pushing the molds. As a result of a series of these operations, a flaskless upper mold and a flaskless lower mold can be produced.

Incidentally, for the next operations for producing another pair of molds, if it is necessary to set a core in the molds, then the carriage 209 is kept at the station S1 for setting a core. In contrast, when molds that need no core are to be produced, namely, if it is unnecessary to set a core in the molds, the carriage 209 is manually moved to the station S2, which station S2 is in a portion that does not operate, by releasing the locking means for the carriage 209. Then, the carriage 209 is fixed to the position in the station S2 by a locking means (not shown). (See FIG. 20)

For the second embodiment of this invention, the carriage 209 is manually moved between the station S1 for setting a core and the station S2, which station S2 is in a portion that does not operate. However, the present invention is not limited to this constitution. The carriage 209 may be moved by an actuator (for example, a cylinder or a motor, etc.).

For the second embodiment of this invention, the core N, which is held by the handling tool 201 disposed at the carrier 204, is lowered to just in front of the surface of the lower mold. However, the present invention is not limited to this constitution. The core N may be lowered until it directly contacts the surface of the lower mold.

Further, for the second embodiment of this invention, after the core N, which is held by the handling tool 201 disposed at the carrier 204, is lowered to just in front of the surface of the lower mold (or until it directly contacts the surface of the lower mold), it is released from the handling tool 201 by stopping the vacuuming means and is set in the lower mold. However, the present invention is not limited to this constitution. After stopping the vacuuming means, the core N may be set in the lower mold by pressing it with compressed air. This method is more preferable since it can increase the certainty of releasing the core N, and prevent the core N from failing to separate from the handling tool 201. The core N can be pressed by compressed air by using a vacuuming and pressing means, instead of the vacuuming means.

For the second embodiment of this invention, the handling tool 201 is rotated by rotating the rotatable rod 202 by driving the motor (not shown). However, the present invention is not limited to this constitution. The handling tool 201 may be rotated by rotating the rotatable rod 202 by means of an arm that is connected to the end of the rotatable rod 202 and by swinging the arm by a cylinder. Or, the rotatable rod 202 may be rotated by means of a cam mechanism, instead of an actuator such as a cylinder.

What we claim is:

1. A molding apparatus for producing an upper and lower mold having a core set therebetween comprising:

a main body;

a cope and a drag flask mounted for movement toward and away from each other on the main body;

a match plate;

a transferring mechanism for transferring the match plate to and from a position between the cope and drag flask;

upper and lower squeezing members insertable into the cope and drag flask to define upper and lower molding spaces in the cope and drag flasks, respectively, when the match plate is in position between the cope and the drag flask, each space having a predetermined volume;

a sand-supplying mechanism for filling the molding spaces with sand;

a pair of cylinders for driving the upper and lower squeezing members to squeeze the molding sand in the upper and lower molding spaces after they are filled to produce an upper and lower mold in said spaces;

a core-setting apparatus for setting a core in the lower mold of the drag flask after the upper and lower molds have been produced and the cope and drag flask are separated from each other and the match plate, the core-setting apparatus including:

a handling tool having vacuuming means or clamping means for removably holding the core to the handling tool;

a rotatable rod for supporting the handling tool for rotation about an axis of the rod;

a carrier that supports the rotatable rod for transferring the handling tool and the core to and from a location above the lower mold in the drag flask; and an actuator mounted on the main body of the molding apparatus for lowering the cope flask together with the carrier and the handling tool holding the core when the handling tool is located above the lower mold to set the core in the lower mold and for lifting the cope flask together with the carrier and the handling tool after the core has been set in the lower mold.

2. The molding apparatus of claim 1, further comprising a pair of rails disposed at opposite outer side walls of the cope flask for transferring the carrier and the handling tool to the location above the lower mold in the drag flask, the pair of rails being lowered and lifted together with the cope flask by the actuator.

3. The molding apparatus of claim 1, wherein the handling tool rotates about the axis of the rod from a position where the core is placed facing upwardly on the handling tool and held in place by the vacuuming means or the clamping means to a position where the core faces downwardly when it is above the lower mold in the drag flask so that the core can be released from the handling tool and set in the lower mold.

* * * * *